United States Patent [19]

Phillips et al.

[11] Patent Number: 4,861,039

[45] Date of Patent: Aug. 29, 1989

[54] METHOD OF PLAYING A MAGNETIC CHECKERS GAME

[76] Inventors: E. Lakin Phillips, 2733 Centerville Rd., Herndon, Va. 22071; Bernardino Romero, 8500 SW. 99th Ave., Miami, Fla. 33173

[21] Appl. No.: 226,629

[22] Filed: Aug. 1, 1988

[51] Int. Cl.[4] ..... A63F 3/00; A63F 3/02

[52] U.S. Cl. ..... 273/239; 273/260; 273/288

[58] Field of Search ..... 273/239, 288, 260, 1 M

[56] References Cited

U.S. PATENT DOCUMENTS

| | | | |
|---|---|---|---|
| 2,052,797 | 9/1936 | Read | 273/288 |
| 3,680,865 | 8/1972 | Davis | 273/239 |
| 3,746,343 | 7/1973 | Shapiro | 273/239 |

*Primary Examiner*—Edward M. Coven

*Assistant Examiner*—Benjamin H. Layno

*Attorney, Agent, or Firm*—Herbert W. Larson

[57] ABSTRACT

A checkers game having two sets of twelve square pieces played on a sixty-four square board. Each checker of one set has a positive magnetic pole imbedded in one vertical side face. Each checker of the other set having a negative magnetic pole imbedded in one vertical side face. An opponent's checker is captured by moving an attacking checker adjacent an opponent's checker and successfully orienting the attacking checker piece such that its magnetic pole directly faces the opposite magnetic pole of the opponent's checker piece thereby causing a magnetic attraction. The two players make alternative moves by moving one square forward, sideways, back, diagonally, rotating a piece ninety or one hundred-eighty degrees, or over an adjacent piece in a jump. The play continues until one player removes all the checkers of his opponent.

4 Claims, 2 Drawing Sheets

METHOD OF PLAYING A MAGNETIC CHECKERS GAME

BACKGROUND OF THE INVENTION

1. Field of the Invention

This invention relates to a checkers game. More specifically, it refers to a game of checkers in which one side of each player's checkers has a magnetic force attractive to one side of his opponent's checkers.

2. Description of the Prior Art

The game of checkers has been played for hundreds of years in various forms. In the conventional form of the game, a player's checker is taken by the opponent jumping over his checker. Variations of this game are common. An example of such a variation is found in U.S. Pat. No. 3,761,092, wherein a checkers game is described having different polarity magnets in each of the player's twelve pieces. The magnets are oriented with positive pole up or down relative to a zodiac label so that each piece is related to other pieces in conformity with affinities or non-affinities between respective signs of the zodiac. This game adds to the competitivenss of a standard checkers game.

SUMMARY OF THE INVENTION

We have invented a method of playing a checkers game utilizing magnetic forces to attract an opponents checkers when strategically positioned. An added dimension is added to the game by having the magnetic force positioned on just one edge of a square checker. A move may constitute just turning a checker ninety degrees to bring its magnetic force in opposition to a checker owned by an opponent so the checker can be captured.

The pieces of each player are all standardized with either a negative or positive pole facing one edge of each checker. However, the pieces of a given player must all have the same polarity facing one edge of the piece, which is the opposite of the polarity of his opponent's pieces facing a single edge.

The two players make alternate moves by moving one square box to the right, left, straight ahead, back, diagonally or turning a piece ninety or one hundred-eighty degrees. The moving player is able to jump over an adjacent playing piece with the objective of landing adjacent an opponent player's piece and to capture that piece if matching positive and negative poles meet. The attacking player continues to move as long as he takes an opponent's piece on the move. A moving player's turn is completed after landing adjacent an opponent player's piece or turning his piece without capturing the opponent's piece. The game continues with each player making moves until one player captures all his opponent's pieces.

BRIEF DESCRIPTION OF THE DRAWINGS

This invention may be best understood by those having ordinary skill in the art by reference to the following detailed description when considered in conjunction with the accompanying drawings in which.

DETAILED DESCRIPTION OF THE INVENTION

Figure 1:
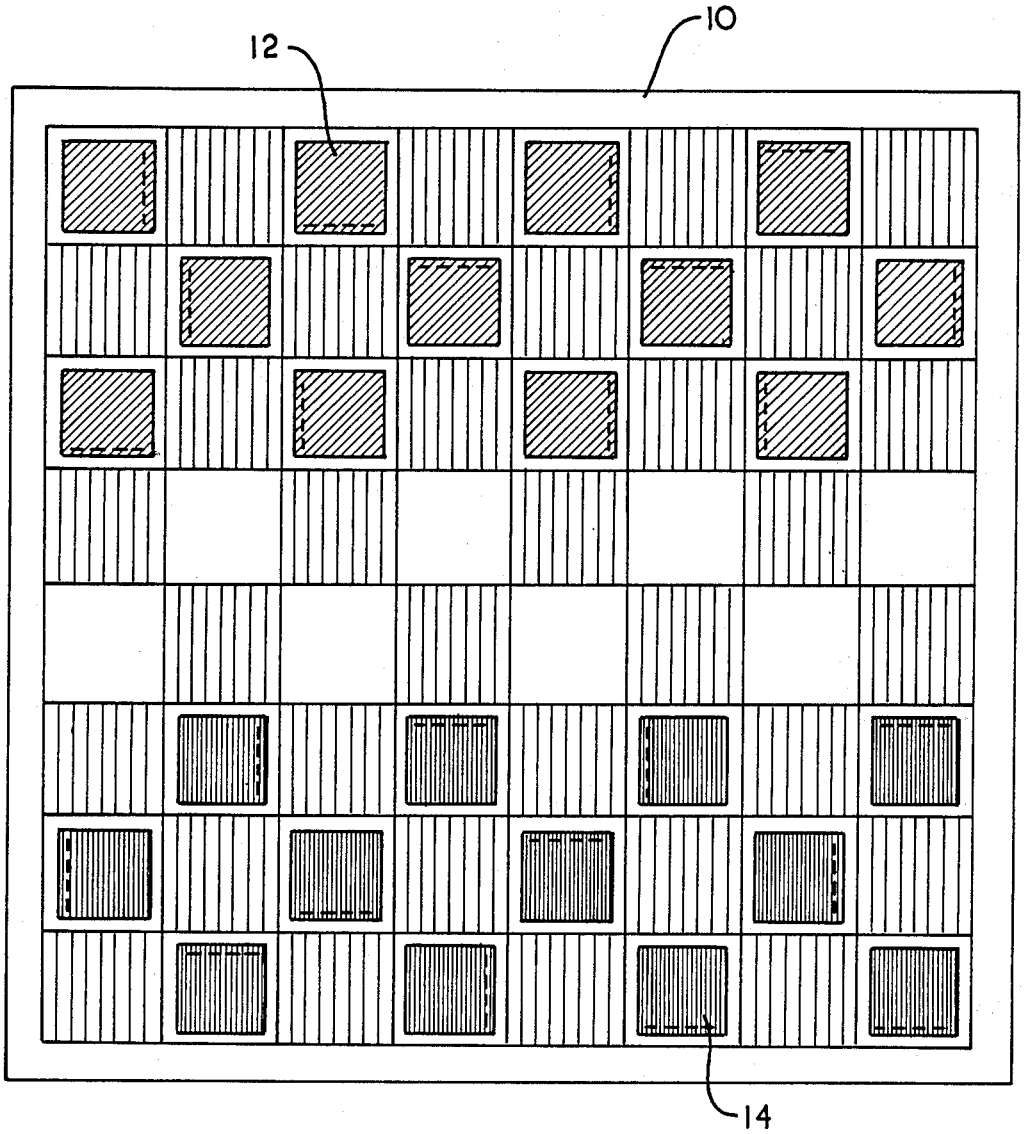
FIG. 1 is a top plan view of a standard sixty-four square playing board with each side's pieces in position to start the game.
Figure 3:
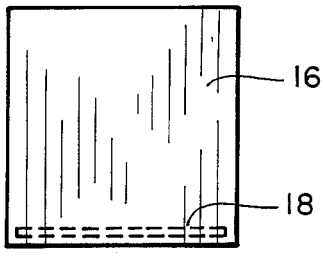
FIG. 3 is a top plan view of the playing piece without a knob.
Figure 2:
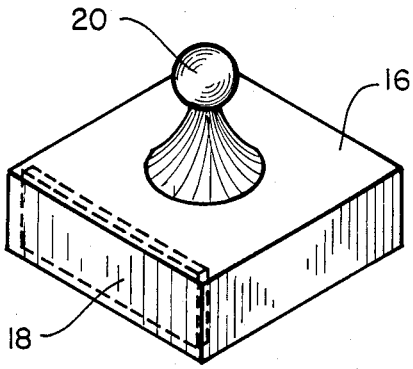
FIG. 2 is a perspective of a player's piece with knob showing the inserted magnet in phantom.
Figure 4:
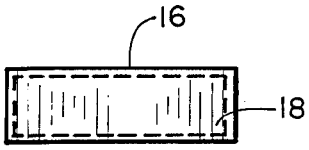
FIG. 4 is a front view of a playing piece without a knob.
Figure 6:
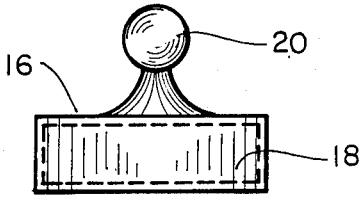
FIG. 6 is a side view of a playing piece with a knob on the top surface.
Figure 5:
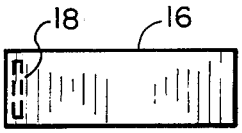
FIG. 5 is a side view of the playing piece without a knob.
Figure 7:
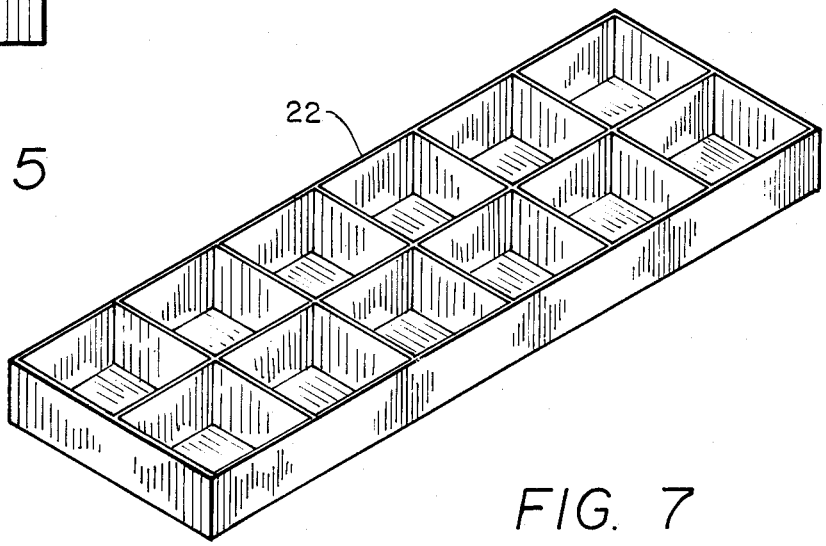
FIG. 7 is a perspective view of the storage rack for retaining the playing pieces.

Throughout the following detailed description, the same reference numerals refer to the same elements in all figures.

The playing surface 10 constitutes a sixty-four square board which may or may not be colored in alternate squares. It makes no difference whether the various boxes are colored since the pieces in this game can move in any direction. One player's pieces 12 are lined alternately in rows of four as in a standard checkers game and his opponent's pieces 14 are likewise positioned in rows of fours as in a standard checkers game. The difference is that the pieces 12 of a first opponent are all positively charged on one edge as shown in FIG. 1. The player can mount his pieces on the board with the magnetic polarity positioned in any direction. The bottom of the piece 12 will be marked with a plus sign on one edge to show the location of the magnet. This will enable the player to determine his strategy but his opponent will not know, at least initially, where the positive charge is located.

The opponent's pieces 14 will all have a negative pole positioned on one side of the checker piece also in a random fashion and marked on the bottom with a minus sign to prevent his opponent from seeing the location of the magnet.

The pieces will normally be in the shape of a square piece or checker 16 and have a magnet 18 imbedded within one surface with only one magnetic field being available for use.

A knob 20 can be optionally placed on top of the piece 16 in order to facilitate moving that piece.

The players try to capture the opponent's checkers, not by jumping, but rather by magnetically attracting the opponent's checker. Since the opponent does not known which side of the checker of his opponent has the magnet, each move is a mystery. Upon landing on a new spot adjacent to an opponent's piece, if there is no attraction between the pieces, the move is over. The opponent may then simply turn his piece ninety or one hundred-eighty degrees for his turn. If still there is no attraction, the turn changes to the opponent and play continues until a move is made that results in an attraction force between the opponent's pieces. The party moving to create the magnetic attraction, takes his opponent's piece and then can make another attacking move.

Either player can jump his own piece or his opponent's piece horizontally, vertically or diagonally in order to get to another opponent's pieces but only one such move can be made in a given turn. A space must be vacant to accept a player's moving piece.

Once the person has moved and not captured his opponent's pieces it is the opponent's move as described above. In the strategy of this game, if a player does not succeed in attracting his opponent's piece on a given move, he may wish to move another piece in another square on his next move in order to try to determine the opponent's lineup of polarity.

The kings row used in a regular checker game is of no value in this game. One does not crown a checker but merely continues to take an opponent's pieces until the opponent is depleted of all his pieces.

Either player can move a piece up or down on a board or sideways, one space at a time, without attracting the opponent's piece but a diagonal jump is restricted to only one such jump with a given move. One player cannot move two spaces on a given turn without jumping a piece either one's own or the opponent's piece. Therefore, a non-jumping turn is restricted to one square. A turning of the piece ninety degrees is another move.

The knob 20 is provided on the piece 16 in order to avoid getting dirt or moisture on the sides of the piece.

When play is not going on or after a piece has been captured, there is a rack 22 provided for the safe positioning of the pieces in storage. Rack 22 is merely a convenience for the players and may be magnetic to prevent the pieces from readily moving.

This game provides additional strategy over heretofore known checker games since this game requires players to attempt to figure out the polarity of his opponent's pieces and once that it known, to keep it in mind until he is able to face that piece with the opposite pole from one of his own pieces. The game is a mind teaser in that it requires remembering specific sides on numerous pieces of one's opponent.

The foregoing disclosure is representative of a preferred form of the invention and is to be interpreted as an illustration of the best mode. Variations of the game may be made without departing from the scope of the invention.

Having thus described the invention, what is claimed and desired to be secured by Letters Patent is:

1. A method of playing a two player game using in combination a checker board having sixty-four square boxes, first and second sets of movable playing pieces, the sets being distinguished by different colors and each having four flat facing surfaces at right angles to each other, the first set of playing pieces having a magnetic device with a positive pole imbedded within one of the four facing surfaces on each playing piece, the second set of playing pieces having a magnetic device with a negative pole imbedded within one of the four facing surfaces on each playing piece, each playing piece having an identifying code on a bottom surface, the two players making alternative moves by moving one square box to the right, left, straight ahead, back, diagonally or turning a piece ninety or one hundred-eighty degrees, the moving player being able to jump over an adjacent playing piece with the objective of landing adjacent an opponent player's piece and to capture that piece if matching positive and negative poles meet, the moving player's turn being completed after landing adjacent an opponent player's piece without capturing the opponent's piece, the game continuing with each player making moves until one player captures all his opponent's pieces.

2. A method of playing a game in accordance with claim 1 wherein each player moves up to twelve pieces during the course of the game.

3. A method of playing a game in accordance with claim 1 wherein the player grasps an upwardly extending knob from a top surface of a piece while making a move.

4. A method of playing a game in accordance with claim 1 wherein at the conclusion of the game each player places his pieces in a storage rack magnetically configured.

* * * * *